US007396251B2

(12) United States Patent
Kuo

(10) Patent No.: US 7,396,251 B2
(45) Date of Patent: Jul. 8, 2008

(54) CABLE ASSEMBLY WITH IMPROVED STRESS RELIEF

(75) Inventor: Peter Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/786,092

(22) Filed: Apr. 10, 2007

(65) Prior Publication Data

US 2007/0238347 A1 Oct. 11, 2007

(30) Foreign Application Priority Data

Apr. 10, 2006 (CN) ..... 2006 2 0072330

(51) Int. Cl.
*H01R 13/56* (2006.01)

(52) U.S. Cl. ..... 439/447; 439/457; 439/687; 439/731

(58) Field of Classification Search ..... 439/447, 439/457, 460, 465, 687, 731
See application file for complete search history.

(56) References Cited

U.S. PATENT DOCUMENTS

| | | | | |
|---|---|---|---|---|
| 6,431,904 | B1 | 8/2002 | Berelsman | |
| 7,163,424 | B2 * | 1/2007 | Dancel et al. | 439/731 |
| 7,214,107 | B2 * | 5/2007 | Powell et al. | 439/729 |
| 2007/0235316 | A1 * | 10/2007 | Kuo et al. | 200/6 A |
| 2007/0238347 | A1 * | 10/2007 | Kuo | 439/447 |
| 2007/0247325 | A1 * | 10/2007 | Kuo et al. | 340/825.57 |

* cited by examiner

*Primary Examiner*—James Harvey
(74) *Attorney, Agent, or Firm*—Wei Te Chung

(57) ABSTRACT

A cable assembly includes a pair of cover halves which are mated with each other, and together define a receiving space, and a rib inwardly extending from inner surface of the cover halves, a cable with a stress relief integrally molded thereon, each cover half includes at least a hollow column extending toward the receiving space, and the stress relief includes a slot fitly engaged with the rib, and a securing head ahead of the annular slot, the securing head defines a through hole, a hollow column in one cover half extends through the through hole and engages with the other column of the other cover half by an exterior element.

15 Claims, 8 Drawing Sheets

CABLE ASSEMBLY WITH IMPROVED STRESS RELIEF

BACKGROUND OF THE INVENTION

1. Field of the Invention

The present invention is directed to a cable assembly, and more specifically, to a cable assembly with improved stress relief that is suitable for use in data or audio communication applications.

2. Description of Related Arts

In the past, flexible cable is commonly used in date transmission and integrally attached to a plug to form a cable assembly, for achieving interconnection between two electrical applications when the plug is engaged with a mating plug. However, practice has shown that a signification portion of the data or signal loss and/or distortion occurs at the areas with the highest stress, due to flexing, tension or torsional twisting, on the flexible cable. And, such stress also can lead to misalignment of the wires contained in the cable.

One transitional method to minimize the stress associated with such cable is to incorporate some form of stress relief into the cable assembly. And, traditional stress relief members, often acting only as a cover or protective plate, are incorporated with the cable by an injection molding process or assembly. However, this incorporation may be loose and departed from each other, when the cable suffers from excessively torsional twisting or tension. Further, even through a stress relief is provided, a distortion also can happen in joint between the cable and the plug, for the cable driving the stress relief to turn excessively.

Hence, a cable assembly having improved stress relief is desired.

SUMMARY OF THE INVENTION

Accordingly, the object of the present invention is to provide a cable assembly with improved structural characteristics, particularly in the connection between a device and associated data transmission so as to minimize data losses and distortion.

Accordingly, another object of the present invention is to provide a cable assembly with improved stress relief for attaching the cable to a cover reliably and preventing the cable distorting excessively.

To achieve the above objects, a cable assembly in according with present invention, includes a pair of cover halves which are mated with each other, and together define a receiving space, and a rib inwardly extending from inner surface of the cover halves, a cable with a stress relief integrally molded thereon, each cover half includes at least a hollow column extending toward the receiving space, and the stress relief includes a slot fitly engaged with the rib, and a securing head ahead of the annular slot, the securing head defines a through hole, a hollow column in one cover half extends through the through hole and engages with the other column of the other cover half by an exterior element.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
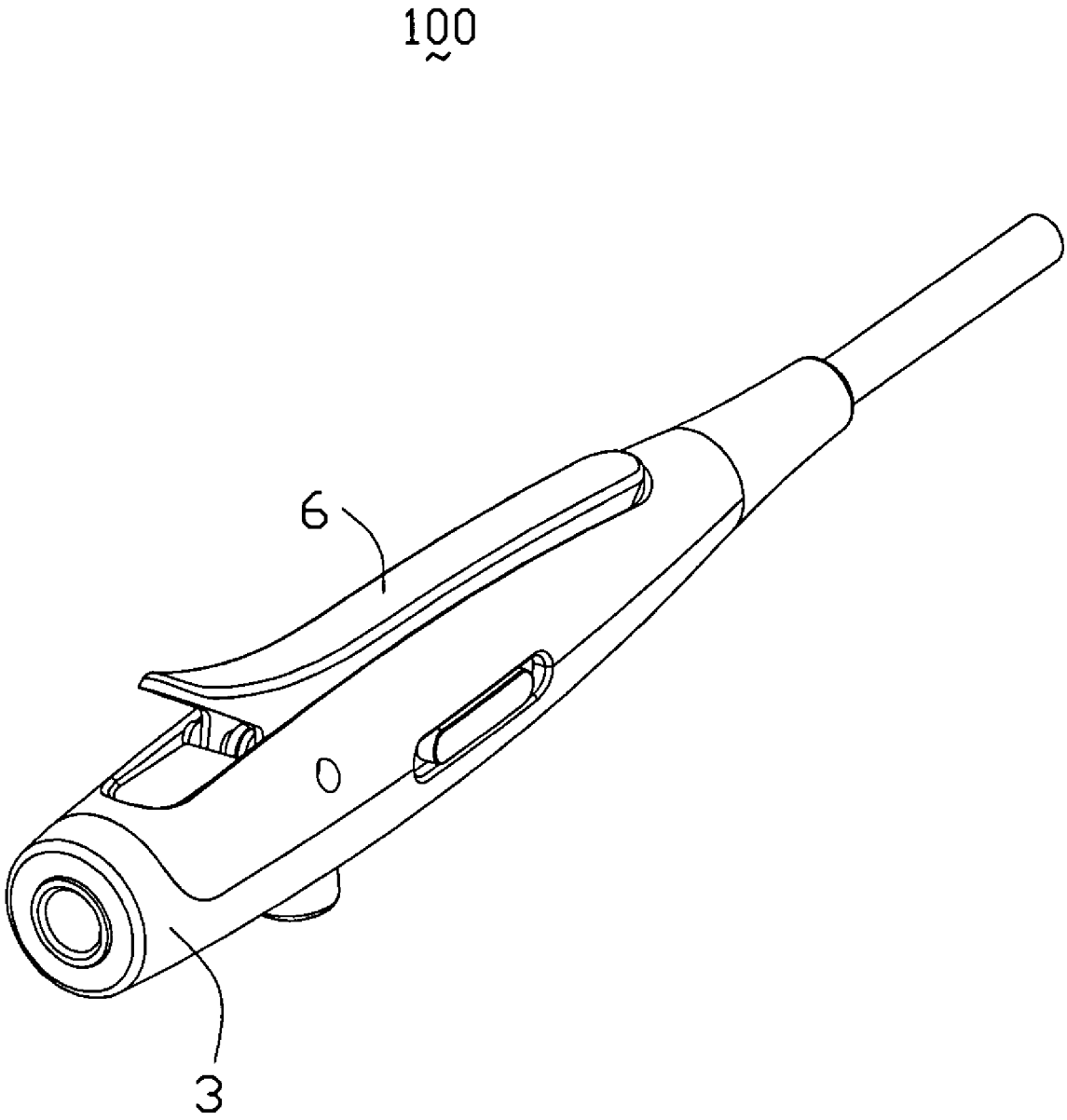
FIG. 1 is a perspective, assembled view of a cable assembly in accordance with the present invention.
Figure 2:
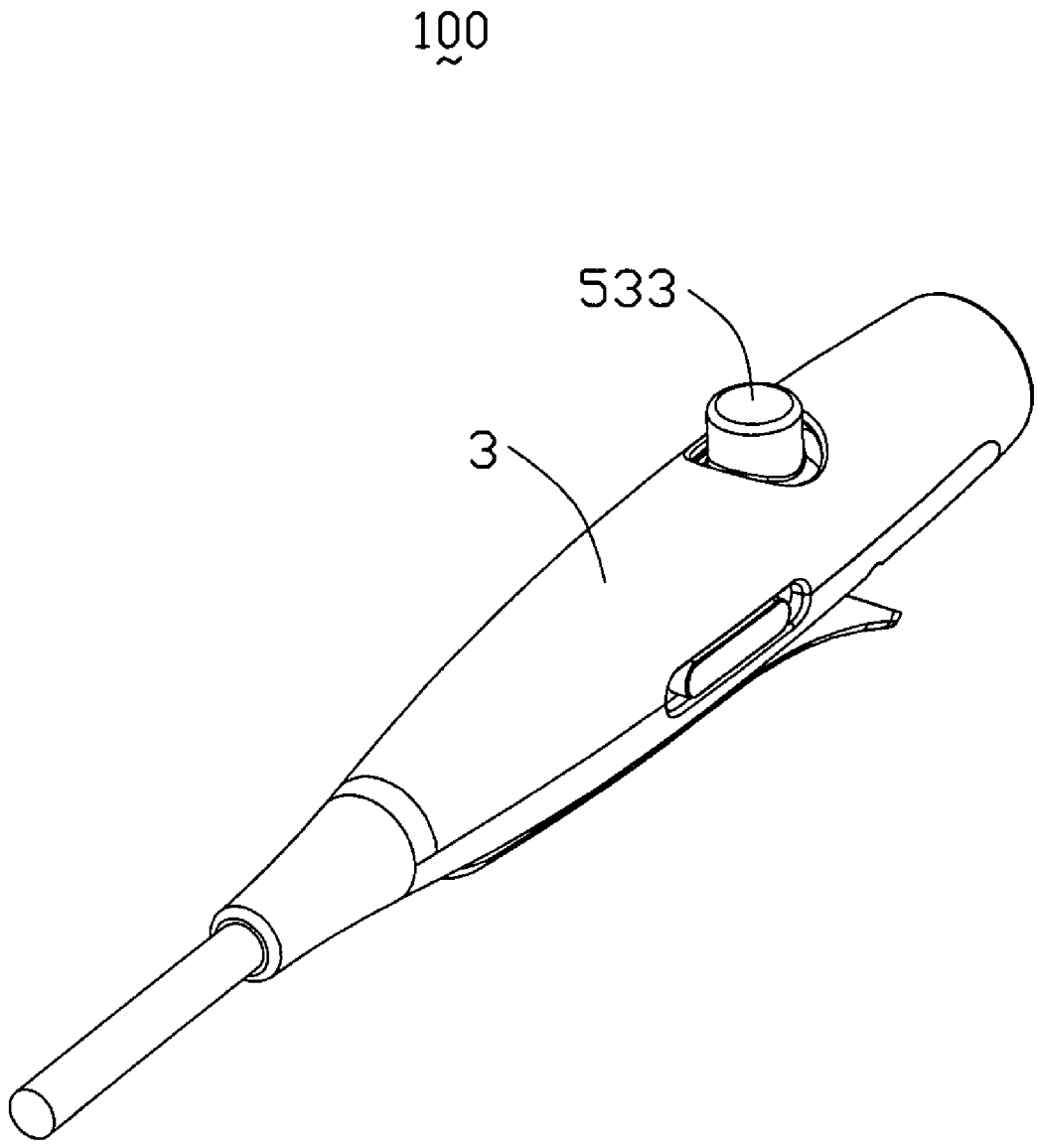
FIG. 2 is a view similar to FIG. 1, but taken from different aspect.

With respect to FIGS. 1-4, the cable assembly 100 in according with a preferable embodiment of present invention is a remote control device for transmitting audio signal between a portable audio device (not shown), such as MP3, and an earphone, which is connected to remote control device. The remote control device is designed to control functions such as sound volume, power on and off, play and stop, fast-forwarding, of the portable audio device remotely and conveniently.

The cable assembly 100 comprises a first cover half 2 with a structure shaped like a boat, a second cover half 3 attached to the first housing piece 2 and defining a receiving space 4 together with the first housing piece 2, a printed circuit board 51 received in the receiving space 4 and with a plurality of components (Detailed depiction shown hereinafter) located thereon, a cable 70 electrically connected to the printed circuit board 51 and with a stress relief 71 disposed at a front portion thereof, and a clip 6 pivotally attached to the first cover half 2 for clipping the cable assembly 100 to a user's clothing or handbag or on some other convenient object.

With respect to FIGS. 1-4, the first and second cover halves 2, 3 are formed of an insulated material with enough rigid, and assembled to each other. The first cover half 2 defines a first pair of positing columns 25, 27 in a front-to-rear direction, which are hollow and open toward exterior. The second cover half 3 defines a pair of second positing columns 35, 37 in alignment with the first columns 25, 35. A pair of screws 11, 12 extends through first positing columns 25, 35, with tips thereof being rotated into the second positing columns 35, 37 for holding two cover halves 2, 3 together.

Figure 3:
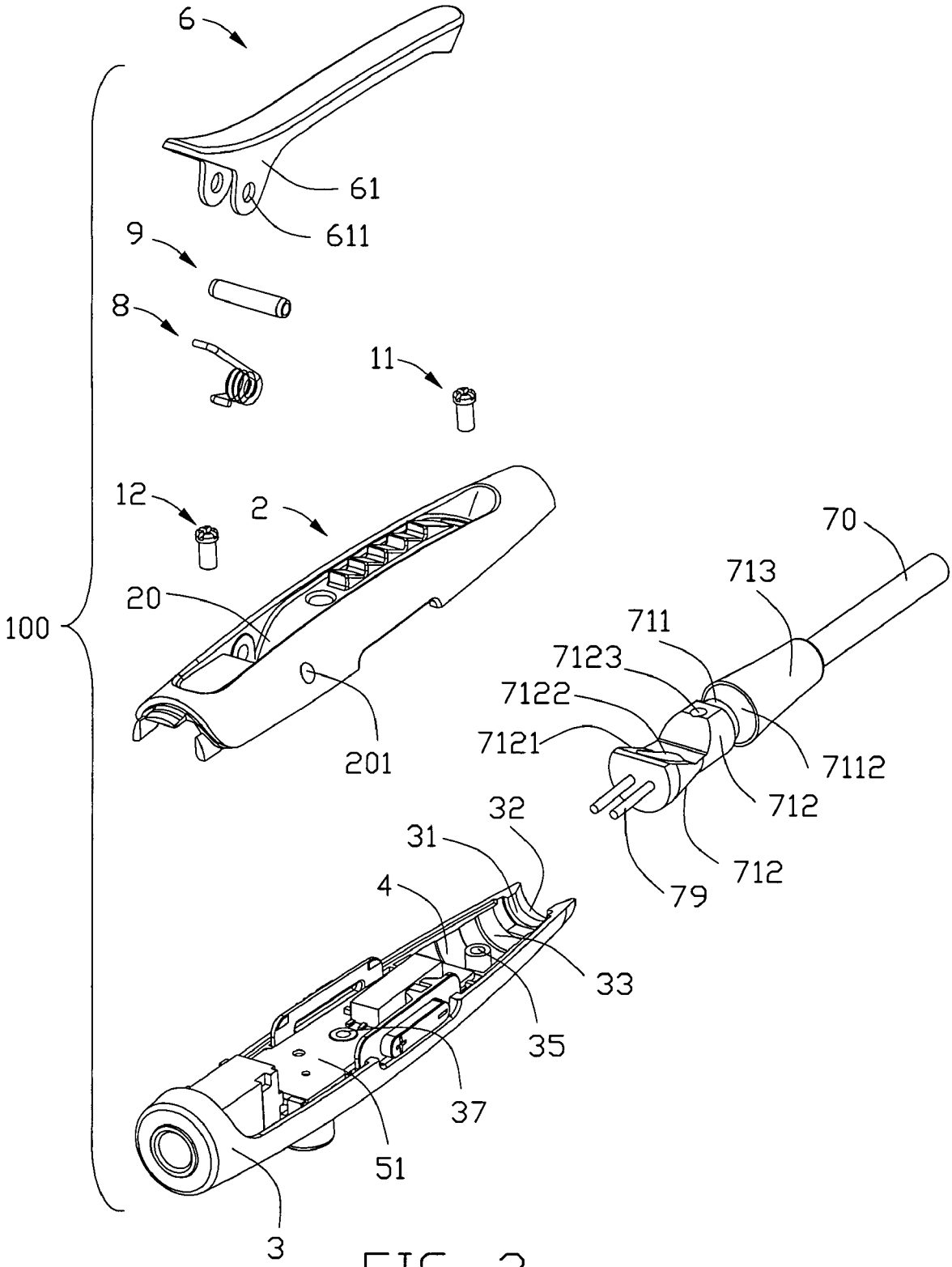
FIG. 3 is an exploded view of the cable assembly shown in FIG. 1.
Figure 4:
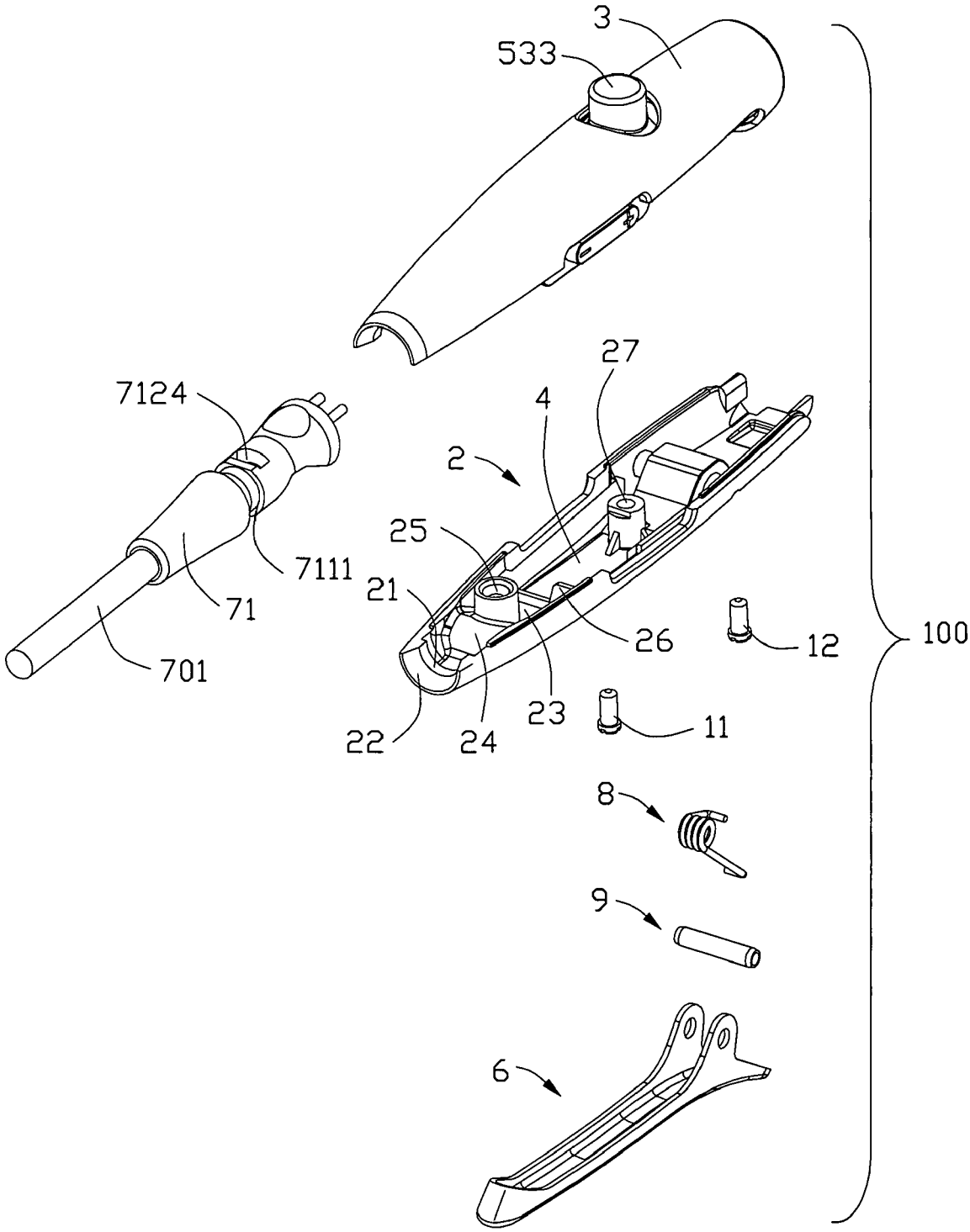
FIG. 4 is a view similar to FIG. 3, but taken from different aspect.
Figure 5:
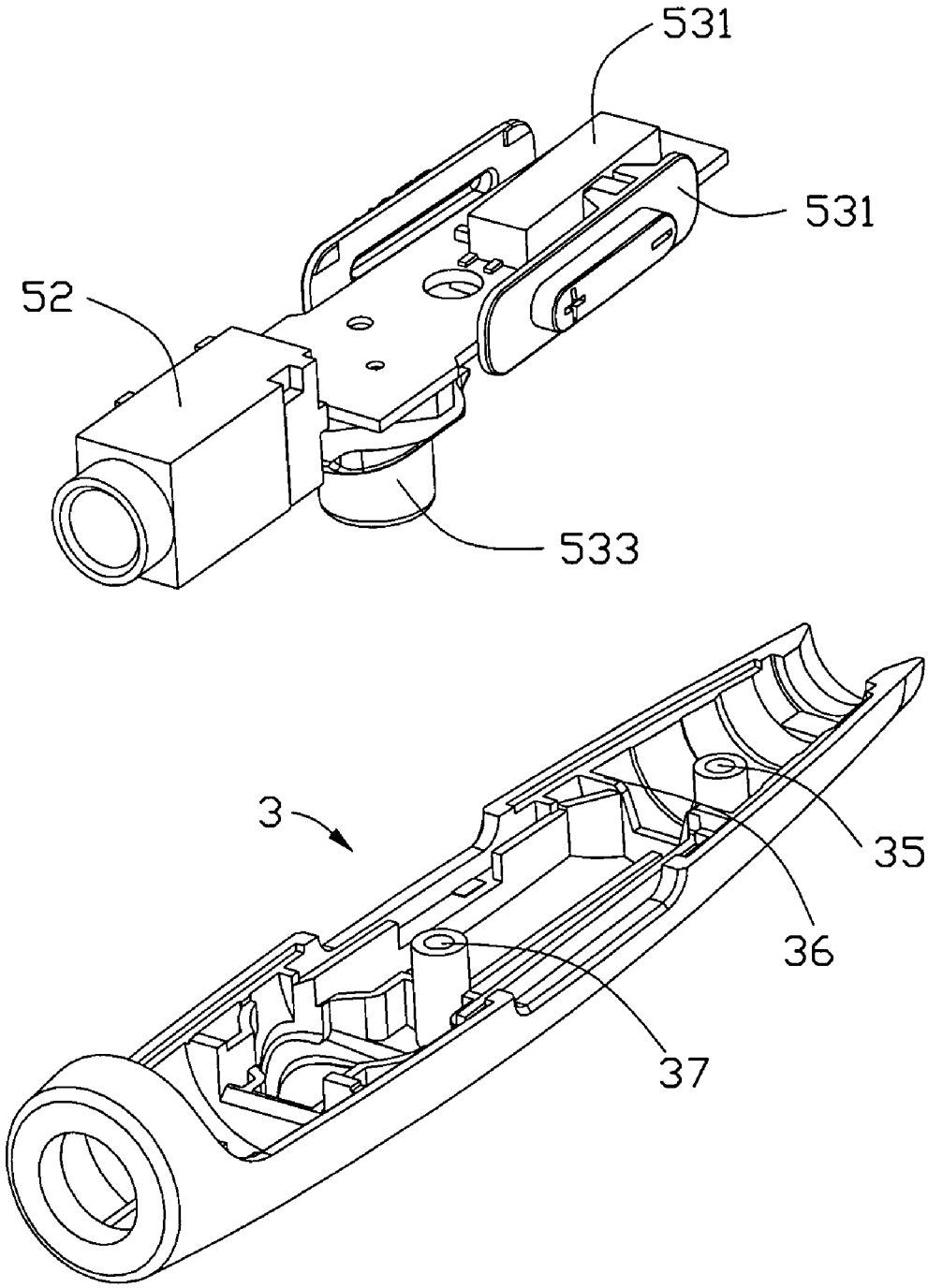
FIG. 5 is a perspective, partially assembled view of the cable assembly shown in FIG. 1.
Figure 6:
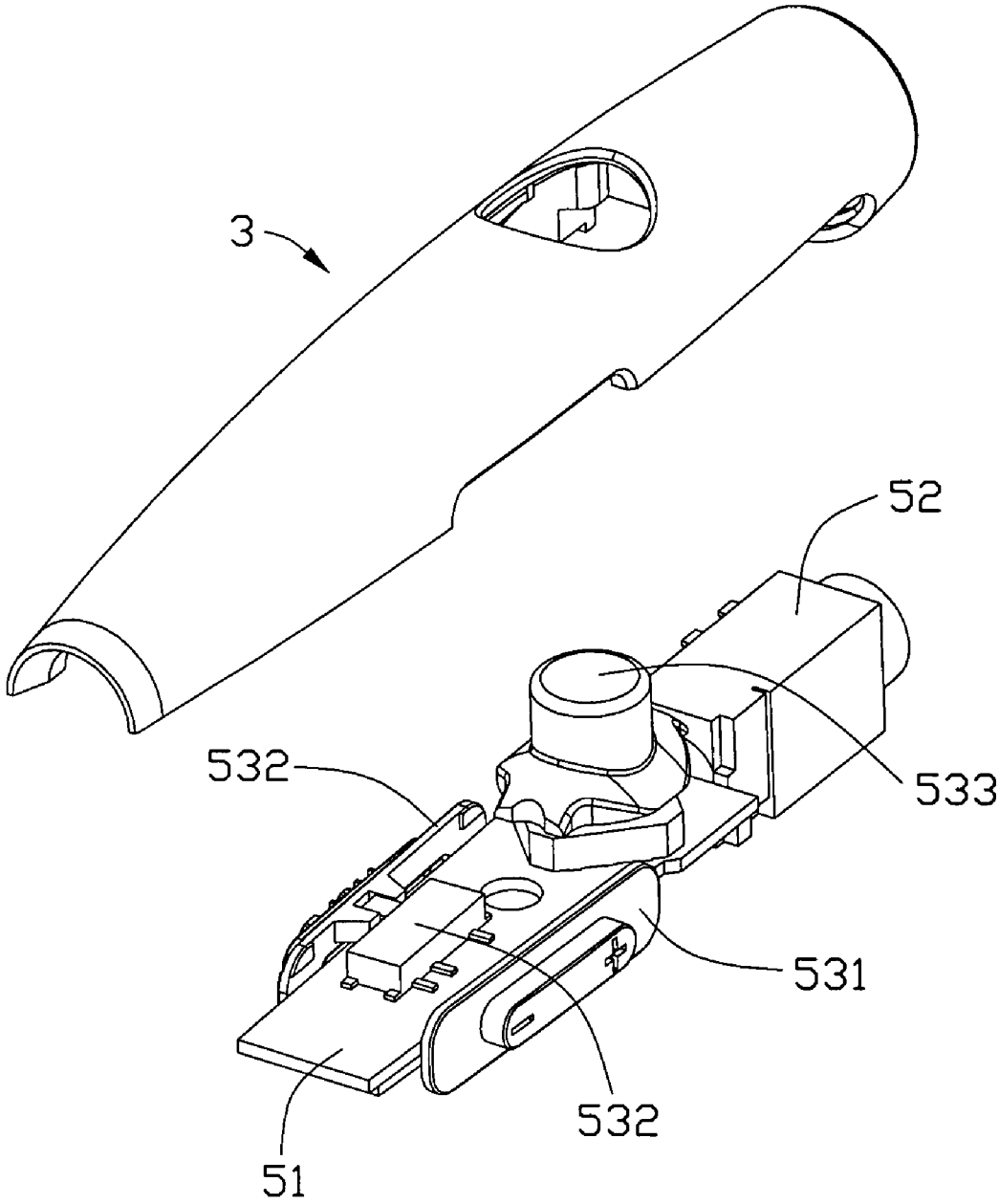
FIG. 6 is a view similar to FIG. 5, but taken from different aspect.
Figure 7:
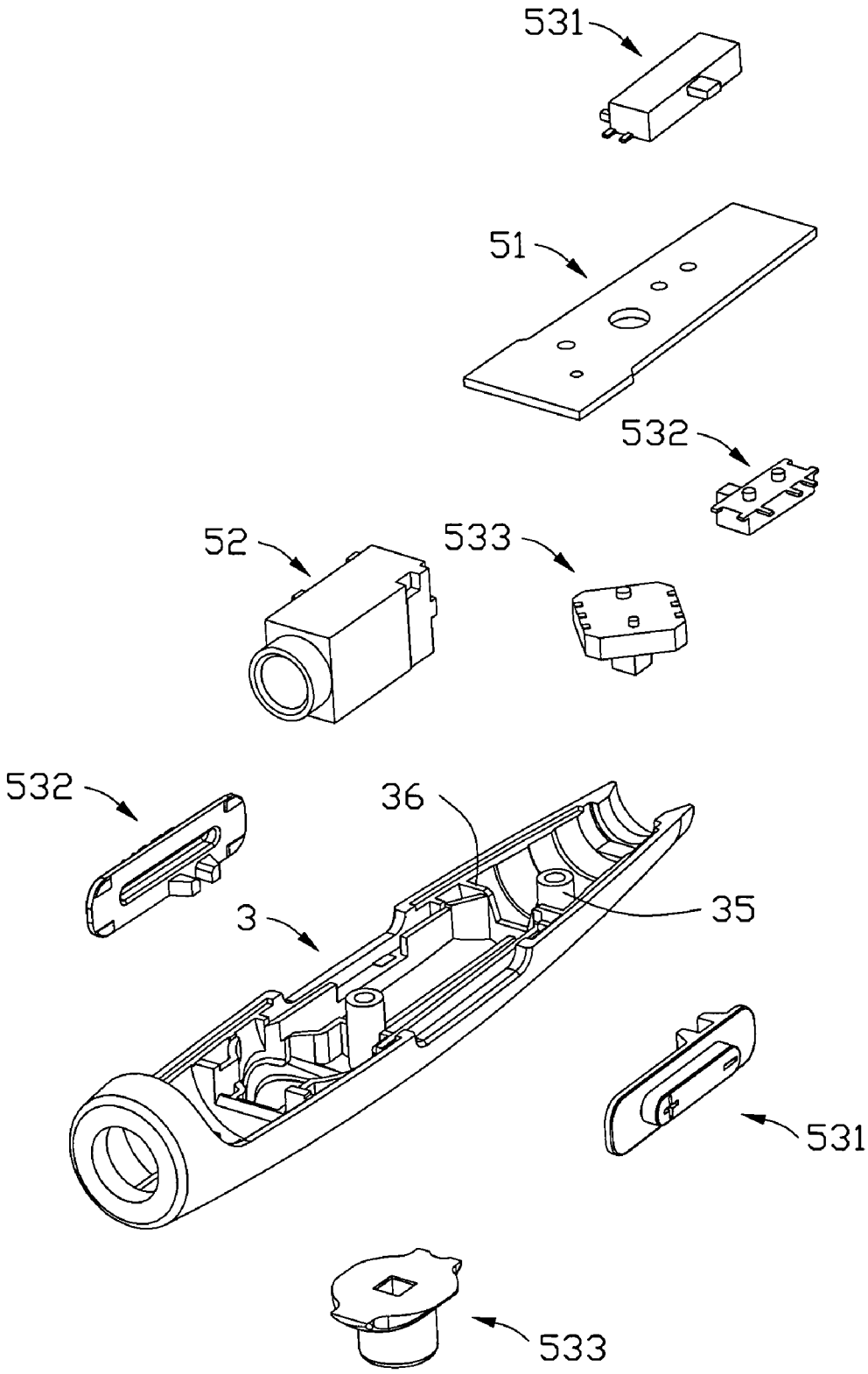
FIG. 7 is an exploded view of the cable assembly in FIG. 5.
Figure 8:
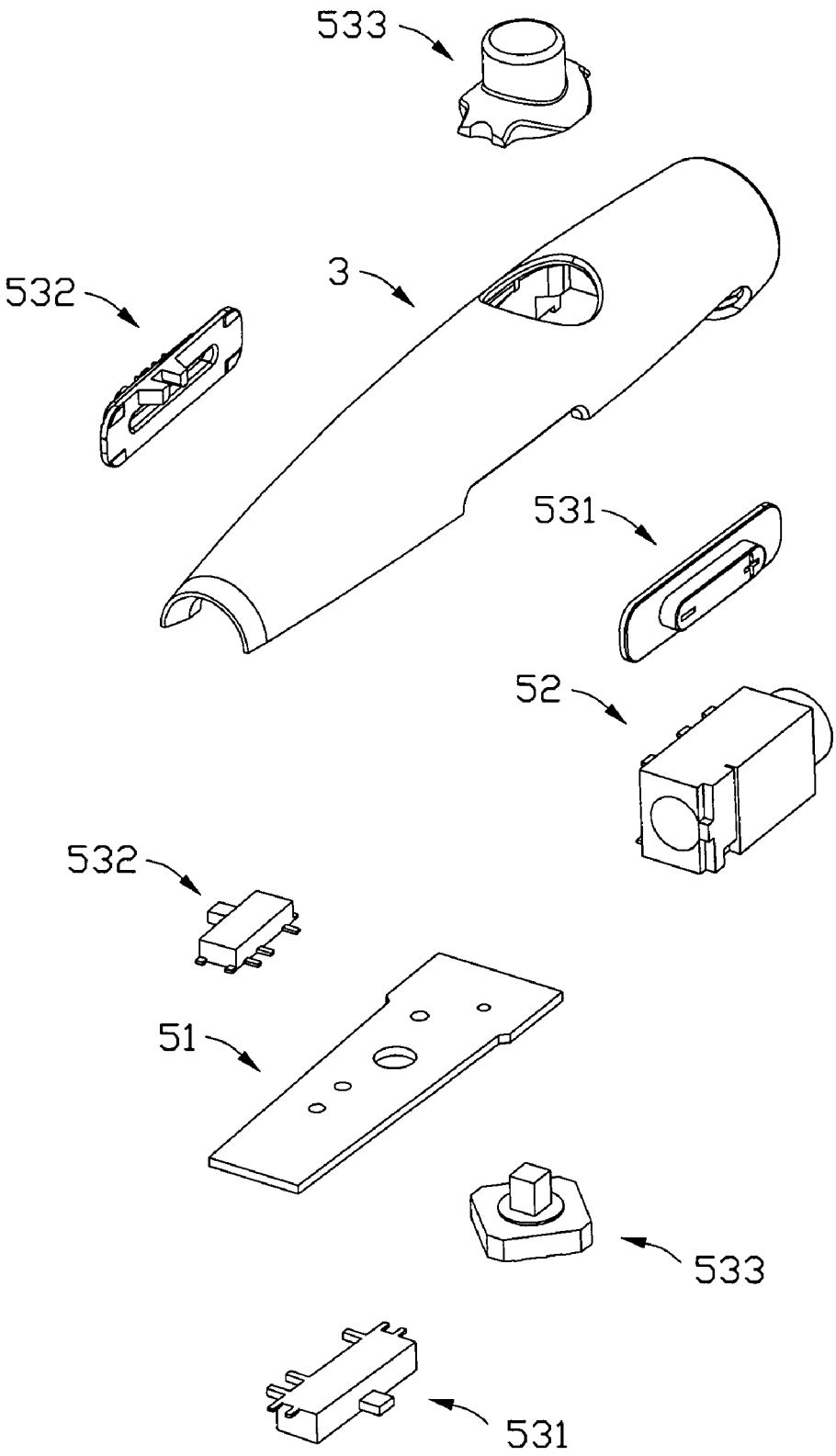
FIG. 8 is another view similar to FIG. 7, but taken from different aspect.

With respect to FIG. 3, the first cover half 2 defines a hollow portion 20, and with a pair of through holes 201 formed at lateral sides thereof and being communicated with the hollow portion 20. And, the clip 6 comprises a longitudinal base (not labeled), and a pair of fixing pieces 61 downwardly extending from one end of the base. Each fixing piece 61 defines a hole 611 therein, which aligns with the through hole 201 and a central hole (not labeled) of a spring 8. A pole 9 extends through the holes 611, 201 and the hole of the spring 8 for attaching the clip 6 to the first cover half 2 and allowing the clip 6 to pivot upon the pole 9.

With respect to FIGS. 3-7, in two generally semi-circular spaces 23, 33 of the first and second cover halves 2, 3, there respectively forms a traverse rib 26, 36 so as to abut against a front surface of the stress relief 71 and prevent a forward trend thereof.

The flexible cable 70 includes a plurality twisting wires or parallel wires 79 for transmitting signals, such as power signal or audio signal, and an insulative jacket 701 surrounding the wires 79, with front parts of wires 79 being exposed beyond the insulative jacket 701. Each wire 79 includes at least a conductor (not shown) for electrically terminated to the printed circuit board 51, and achieving an electrical connection therebetween. The stress relief 71 is integrally molded with a front part of the cable 70, with a plurality of conductors being exposed beyond a front surface thereof for connection. Referring to FIG. 3, the stress relief 71 includes a columned head 712, with a V-shape inclining cut 7121 formed thereon. This columned head 712, shaped decreasingly in diameter along a lengthwise direction, defines a though hole 7122 extending through the incline cut 7121 and aligned with the positing column 35. Said screw 11 extends through the first column 25, the through hole 7122 successively, and into the second positing column 35 for reliably holding the stress relief 71 with the cable 70 within the cover halves 2, 3. In addition, the semi-circular space 23, 33 cooperate together to receive the columned head 712, and the V-shape inclining cut 7121 is suitable to mate with a generally inclining protruding 24, for providing a reliable assembly and preventing a rotation along a lengthwise axis.

The stress relief 71 also includes an annular slot 711, and a rod 713 behind the annular slot 711. The annular slot 711 is lower than the rod 713 and the columned head 712, and shaped as a neck-like configuration. Reversely, each cover half 2, 3 forms a semi-circle rib 21, 31 extending inwardly from inner surfaces thereof, and sequentially, the cover halves 2, 3 form a circumferential rib when these two cover halves 2, 3 engage with each other. The circumferential rib surrounds and interferentially engages with the annular slot 711. By above cooperation, the stress relief 71 is reliably hold in position and can hardly remove forwardly or rearwardly relative to the cover halves 2, 3. Behind the semi-circle rib 21, 31, each cover half 2, 3 form a smooth receiving room 22, 32, with a diameter being increased along a front-to-rear direction after engagement of two cover halves 2, 3. Therefore, these two receiving room 22, 32 together defines a general conic room. Corresponding, a front portion of the rod 713 is shaped smoothly to form an ascending wall 7112, this wall 7112 forms an ascending grade structure for fitly engaging with the general conic room.

According to above description, the columned head 712 is fitly and closely received in rounded receiving space 23, 33, the V-shape inclining cut 7121 is fitly engaged with the inclining protruding 24, for preventing a distortion upon the cable 70 and stress relief 71. Further, an engagement of the annular slot 711 and the ribs 21, 31, can hold the stress relief 71 in position. An engagement of the ascending wall 7112 fitly and closely is received in the conic room for decreasing distortion when a twisting occurs upon the cable 70. In brief, due to the design of stress relief 71, the cable 70 and engagement between the cable 70 and the printed circuit board 51 can hardly suffer from distortion even if a twisting happens to cable 70.

With respect to FIGS. 5-8, the components simply described above, includes a modular jack 52 located at a front portion of the cable assembly 100, a first sliding switch 531 installed on the printed circuit board 51, which can control a volume, a second sliding switch 532, which can lock other key-presses or switches from an improper operation, and a multiple-direction switch 533, which can control the playing song to stop, fast forwardly move or fast rearwardly return.

During a process to mold the stress relief 71 over the cable 70 conveniently, a pair of poles (not shown) is adopted to hold the cable 70 in position. Then after subsequent processes of cooling the melted plastic material and taking way the mold, a pair of apertures 7123, 7124 are formed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable assembly, comprising:

a cover with a generally columnar configuration, includes a receiving space, a circumferential rib inwardly extending from inner surface thereof toward the receiving space, and a receiving room behind the rib;

a cable includes an insulative jacket, and at least a wire shielded by the jacket and with a front portion thereof extending beyond a front face of the jacket; and a stress relief integrally molded with the cable and engaged with the cover;

wherein the stress relief includes an annular slot, and a wall behind the annular slot with a size varying gradually in a lengthwise direction, said circumferential rib surrounds and interferentially engages with corresponding annular slot, and said wall is fitly received in the receiving room.

2. The cable assembly as described in claim 1, wherein the stress relief includes a rod with a diameter generally varying diminutively, except that the wall formed at a front part of the rob varies increasingly, along a front-to-rear direction.

3. The cable assembly as described in claim 1, wherein the stress relief includes a columned head ahead of the annular slot, with a generally V-shape inclining cut formed thereon, said cover includes a generally inclining protruding for fitly mating with the V-shape inclining cut.

4. The cable assembly as described in claim 3, wherein the columned head includes a through hole extending therethrough from a surface of the inclining cut, and the cable assembly includes a screw extending through a side of the cover and the through hole, with tip of the screw being turned into another side of the cover, for holding the stress relief in position.

5. The cable assembly as described in claim 3, wherein the cover includes at least a pair of hollow columns respectively formed at two opposite walls, wherein one hollow column extends through the columned head, and the cable assembly further includes an exterior fastener, which extends through one hollow column at one wall and fitly engaged with the other column at the other wall, for holding the stress relief in position.

6. The cable assembly as described in claim 3, wherein the cover includes at least a traverse rib inwardly extending toward the receiving space from inner surface thereof so as to abut against a front surface of the columned head, and prevent a forwardly movement of the stress relief.

7. A cable assembly, comprising:

a pair of cover halves which are mated with each other, and together define a receiving space, and a rib inwardly extending from inner surface of the cover halves;

a cable with a stress relief integrally molded thereon; wherein each cover half includes at least a hollow column extending toward the receiving space, and said stress relief includes a slot fitly engaged with the rib, and a securing head ahead of the annular slot, the securing head defines a through hole, a hollow column in one cover half extends through the through hole and engages with the other column of the other cover half by an exterior element.

8. The cable assembly as described in claim 7, wherein the securing head with a generally columned shape, defines a depressed portion, said through hole is open toward the depressed portion.

9. The cable assembly as described in claim 8, wherein one cover half defines an inclining protruding, with a shape similar to that of the depressed portion, for fitly engaging with the depressed portion.

10. The cable assembly as described in claim 7, wherein the stress relief includes a rod with a diameter generally varying diminutively, except that a front knob formed at a front part of the rob varies increasingly, along a front-to-rear direction.

11. The cable assembly as described in claim 10, wherein the cover halves together defines a receiving room, with diameters of sections thereof varying increasingly along a lengthwise direction, for receiving the front knob therein.

12. The cable assembly as described in claim 7, wherein further includes a printed circuit board, which the cable is terminated thereto, and at least a column extending through the printed circuit board so as to mate with another column by a screw.

13. The cable assembly as described in claim 7, wherein one cover half defines a hollow portion, with a pair of through hole defined at two lateral sides thereof, for allowing a clip to mate.

14. A cable assembly, comprising:

a pair of cover halves which are mated with each other, and together define a receiving space;

a cable with a stress relief integrally molded thereon; wherein each cover half includes at least a hollow column extending toward the receiving space, and said stress relief includes a securing head located in the receiving space, the securing head defines a through hole, the hollow column of one cover half extends through the through hole and engages with the corresponding column of the other cover half by an exterior element.

15. The cable assembly as claimed in claim 14, wherein the through hole is located in an inclined cut.

* * * * *